US012709444B2

(12) United States Patent
Magana

(10) Patent No.: US 12,709,444 B2
(45) Date of Patent: Aug. 18, 2026

(54) DOUBLE LOCK CONTAINER AND METHOD FOR LID SECUREMENT

(71) Applicant: Direct Pack, Inc., Azusa, CA (US)

(72) Inventor: Leonardo Magana, San Bernardino, CA (US)

(73) Assignee: Direct Pack, Inc., Azusa, CA (US)

( * ) Notice: Subject to any disclaimer, the term of this patent is extended or adjusted under 35 U.S.C. 154(b) by 77 days.

(21) Appl. No.: 18/415,777

(22) Filed: Jan. 18, 2024

(65) Prior Publication Data

US 2025/0236440 A1 Jul. 24, 2025

(51) Int. Cl.
*B65D 43/02* (2006.01)

(52) U.S. Cl.
CPC .. *B65D 43/0212* (2013.01); *B65D 2543/0024* (2013.01); *B65D 2543/00537* (2013.01); *B65D 2543/0062* (2013.01); *B65D 2543/0074* (2013.01)

(58) Field of Classification Search
CPC ..... B65D 43/0212; B65D 2543/0024; B65D 2543/00537; B65D 2543/0062; B65D 2543/0074
See application file for complete search history.

(56) References Cited

U.S. PATENT DOCUMENTS

| | | | | | |
|---|---|---|---|---|---|
| 3,565,146 | A * | 2/1971 | Arnolds | B65D 43/0204 | 220/4.23 |
| 4,974,738 | A * | 12/1990 | Kidd | B65D 21/0234 | 220/4.24 |
| 7,032,773 | B2 * | 4/2006 | Dees | B65D 43/0206 | 220/4.24 |
| 8,381,944 | B2 * | 2/2013 | Strange | B65D 43/162 | 220/4.23 |
| 2002/0175164 | A1 * | 11/2002 | Dees | B65D 43/0206 | 220/4.24 |
| 2007/0172554 | A1 * | 7/2007 | Blythe | B65D 11/188 | 426/106 |
| 2012/0031921 | A1 * | 2/2012 | Cadiente | B65D 43/162 | 220/788 |

* cited by examiner

*Primary Examiner* — James N Smalley
(74) *Attorney, Agent, or Firm* — FBT Gibbons LLP

(57) ABSTRACT

A double lock container assembly and method for lid securement wherein the container assembly includes a first housing and a second housing. The first housing includes a first portion of a double lock securement including a recess and a protuberance adjacent to the recess. The second housing includes a second portion of the double lock securement including at least one recess. At least one of the first or second housing components additionally includes a protuberance. The protuberance of the first housing can be configured to releasably lock with the at least one recess of the second housing.

20 Claims, 10 Drawing Sheets

DOUBLE LOCK CONTAINER AND METHOD FOR LID SECUREMENT

BACKGROUND

Disposable containers for packaging, distributing, displaying, or otherwise housing consumer items, especially perishable foods, are becoming increasingly important. Historically, perishable products were brought to market and sold quickly to avoid loss due to exposure to natural elements causing ripeness and eventual decay.

The advent of plastics resulted in many products being wrapped or packaged in plastic, both in the form of flexible plastic bags and solid plastic containers. The use of plastics in the modern-day convenience food industry has significantly improved the "shelf life" of perishable products, allowing both merchants and their customers to store their products for longer periods of time, resulting in substantial savings, and greater distribution.

Typically, plastic containers will include a fairly rigid lid and base. Ideally, the lid should be capable of properly and effectively sealing the container, yet the container should be constructed so that the lid is relatively easy to remove, and in some circumstances, replace, since it may be expected that the container and lid would be reused.

Initial use and later reuse of the lid with the base favors hand securement by a user. Mechanical couplings between the lid and the base typically provide sufficient closure and sealing for consumer use. The physical act of coupling a base and a lid generally requires two hands on the base and the lid to simultaneously squeeze the outermost perimeters together in a tedious and often cumbersome fashion. Moreover, should the user fail to properly secure the lid to the base, the container will likely leak resulting in loss of food and/or damaging spills.

Furthermore, in the food service and household settings, although not limited to such settings, amounts of food identified for containing and storing at a given instance may vary considerably. For example, a consumer taking food home from a restaurant may have any desired amount left to store and consume at a later time. The consumer may even choose to eat varying amounts over the course of coming days. The restaurant, or even the consumer, typically has containers of varying sizes to accommodate these differing volumes. Of course, managing more types of containers requires more storage capacity as well as a greater variety of unused storage containers resulting in greater logistical maintenance and inventory monitoring to ensure that the desired containers are available on demand. Moreover, larger containers of these varying sizes tend to fill disposal containers more quickly than smaller containers once discarded such that properly sized containers are preferably available for food in a given instance even after the food has been consumed.

There is thus a need for a container, particularly a disposable container, that addresses present challenges and characteristics such as those discussed above.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
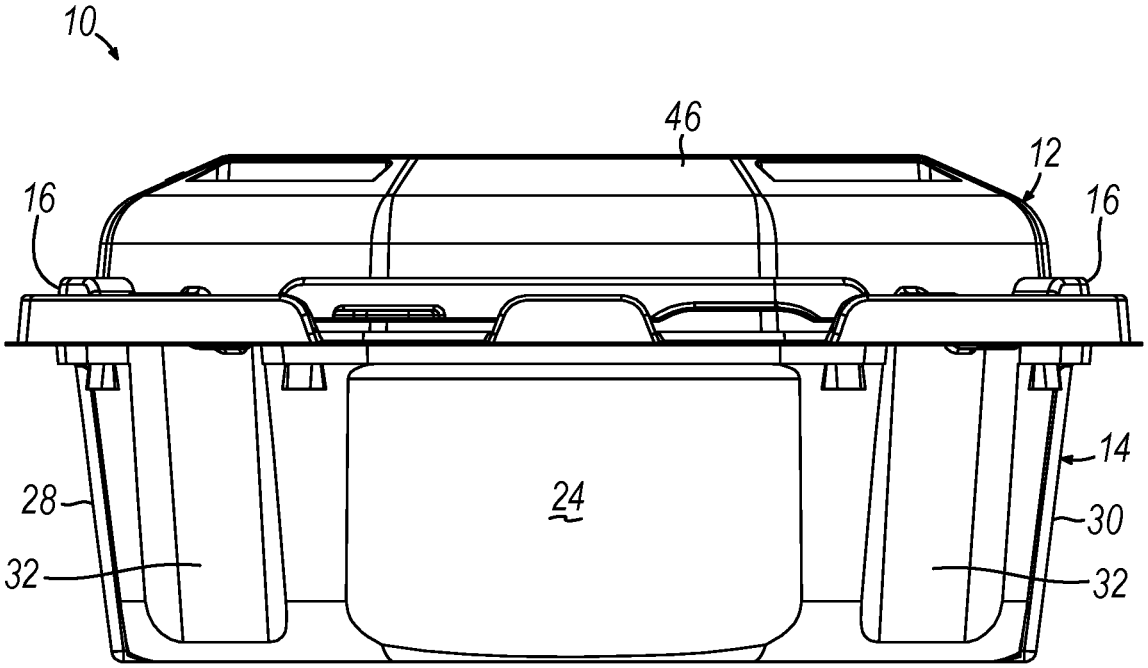
FIG. 1 depicts a side elevational view of one example of a container with a lid connected to a base by an exemplary double lock securement in a dual configuration.

The drawings are not intended to be limiting in any way, and it is contemplated that various embodiments of the invention may be conducted in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for conducting the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, versions, examples, etc. described herein may be combined with any one or more of the other teachings, expressions, versions, examples, etc. that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. CONTAINER WITH DOUBLE LOCK SECUREMENT

Figure 2:
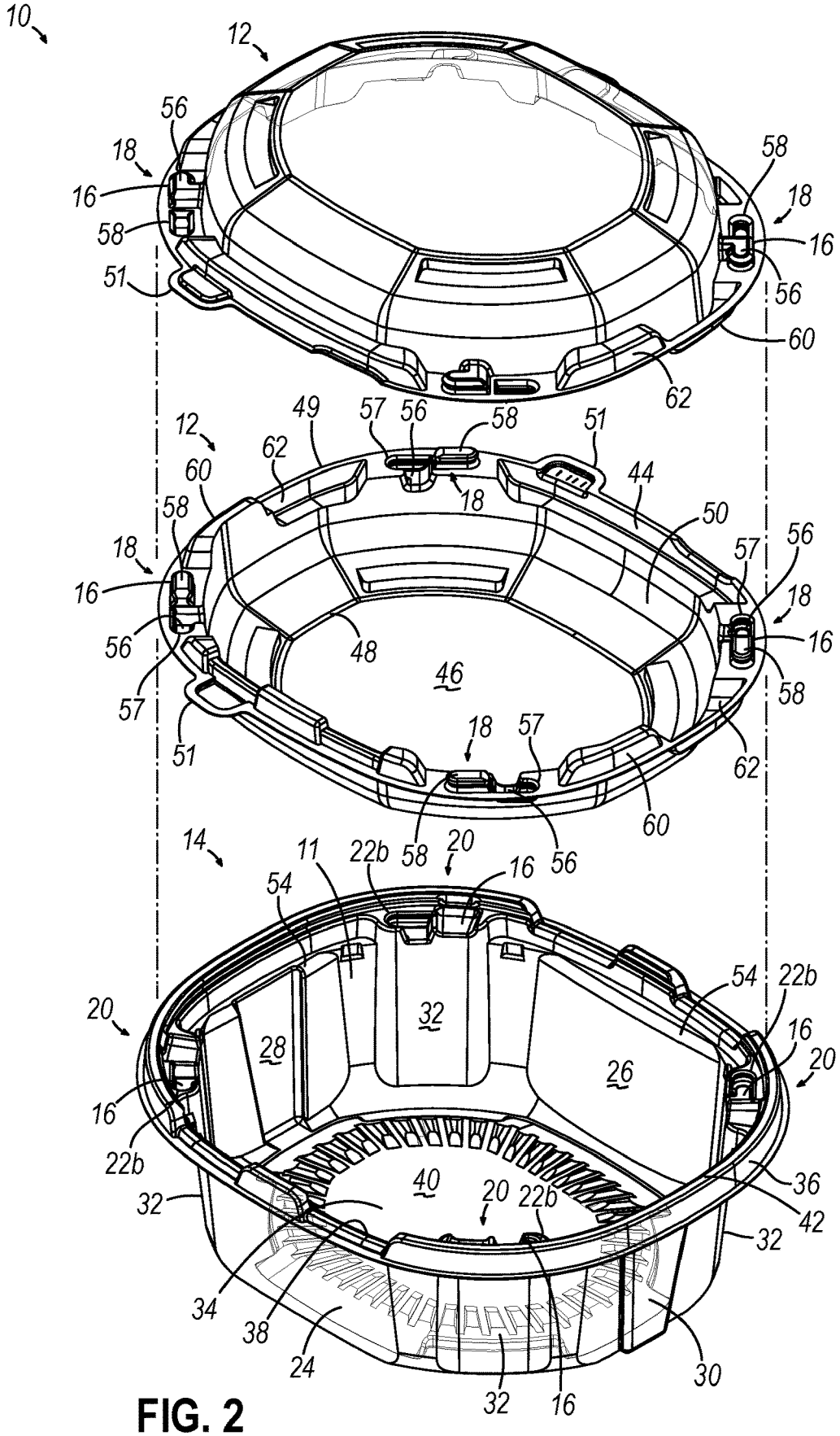
FIG. 2 depicts a perspective view of the container of FIG. 1 with the lids disconnected from the base and each other.
Figure 3:
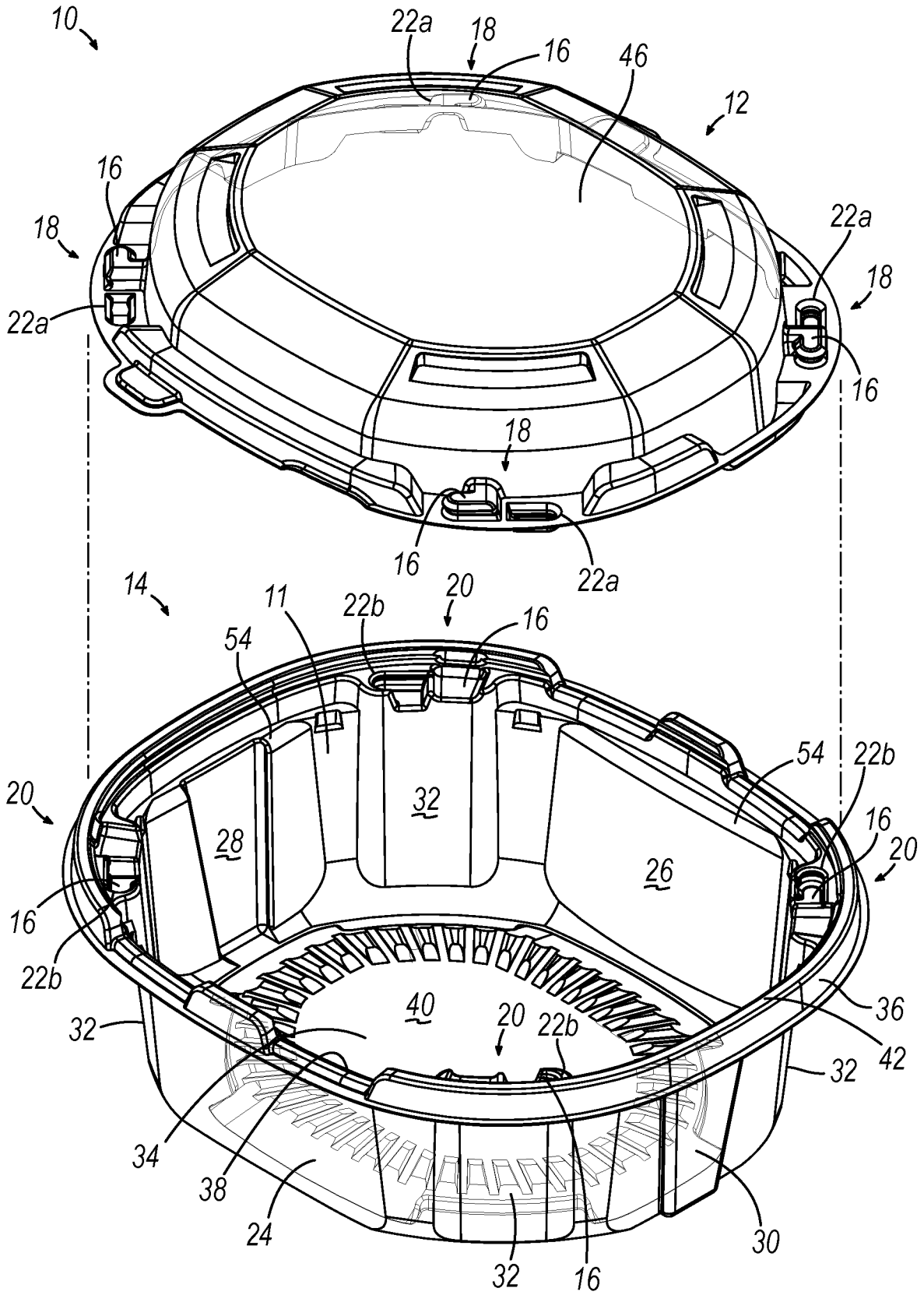
FIG. 3 depicts a perspective view of the container of FIG. 1 in an enlarged configuration with the lid disconnected from the base.

With respect to FIGS. 1-3, a consumer-friendly container (10) of the present example includes a lid housing (12) and a base housing (14) with a double lock inner securement (16), wherein double lock inner securement (16) may also be referred to herein as a housing securement, to releasably connect various housing components together, such as a pair of lid housings (12) and a base housing (14) as a dual configuration, lid housing (12) and base housing (14) as an enlarged configuration, or a first lid housing (12) and a second lid housing (12) for a compact configuration. Although container (10) of FIGS. 1-3 shows a double lock inner securement (16) located adjacent each corner (22*a*) of lid housing (12) and adjacent each corner (22*b*) of base housing (14), it is also contemplated that a double lock securement (16) may be located adjacent only one of corners (22*a*, 22*b*), only two of corners (22*a*, 22*b*), or only three of corners (22*a*, 22*b*). As shown in the present example, double lock inner securement (16) has a lid housing securement portion (18) on lid (12) and a base housing securement portion (20) on base (14) configured to releasably connect various housing components together with single-handed compression for greater ease of enclosing contents, such as food, within container (10). Of course, housing components may be connected together with double lock inner securement (16) with a single-handed application, but more than one hand may be applied in other examples. The disclosure is thus not intended to be unnecessarily limited to single-handed application such that even more than one hand of application, such as two hands, may benefit from greater ease of connection therebetween.

Figure 6:
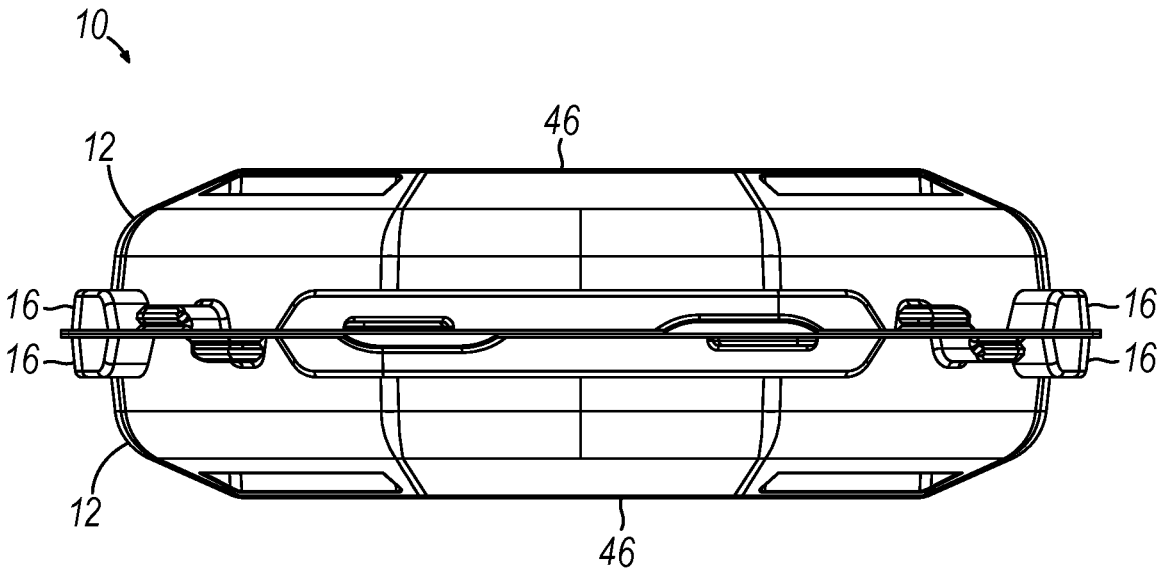
FIG. 6 depicts a side elevational view of a pair of lids of FIG. 1 of the container in a compact configuration.
Figure 7:
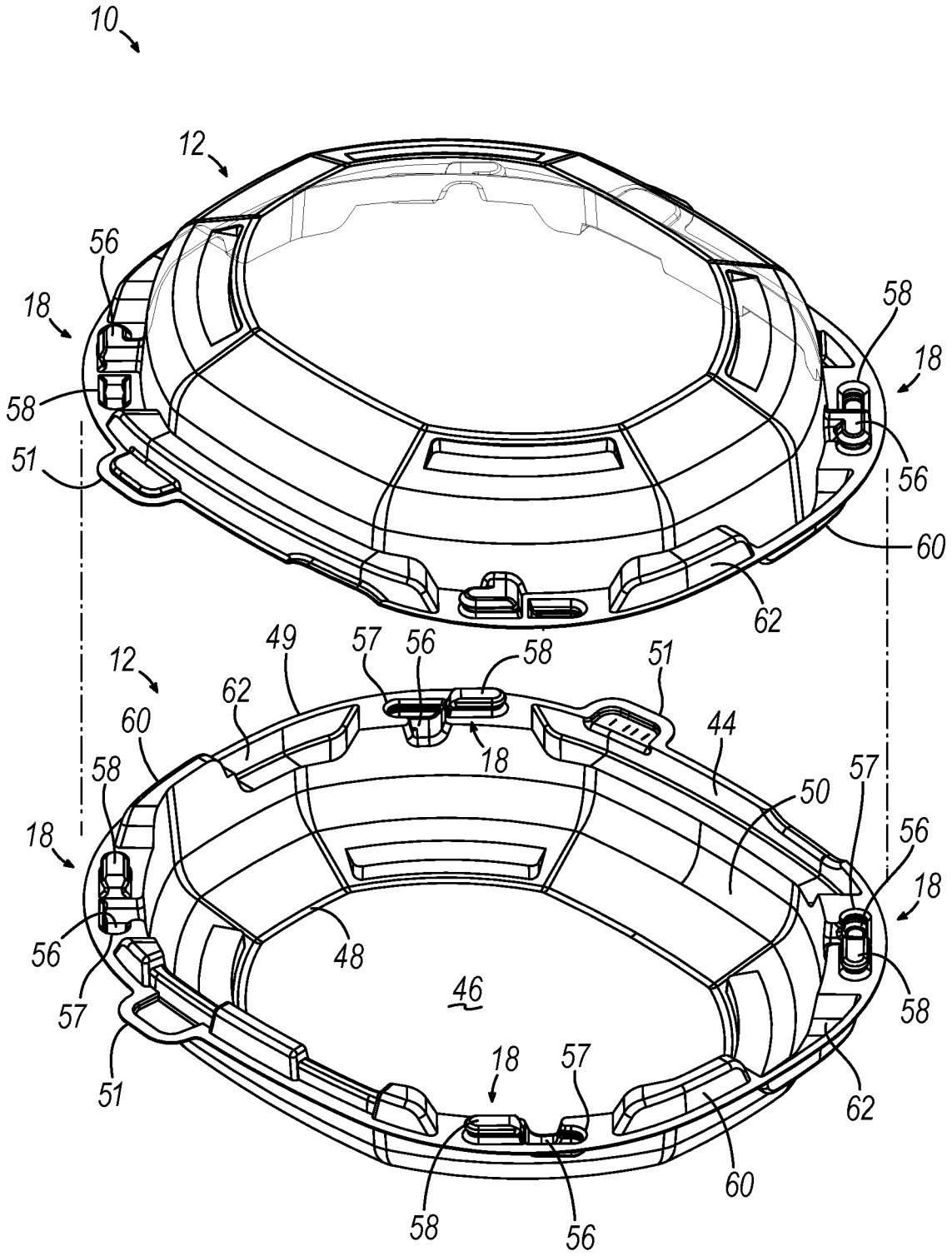
FIG. 7 depicts a perspective view of the container of FIG. 6 with the lids disconnected from each other.

In the present example, as discussed briefly above, container (10) has a dual configuration, such as shown in FIG. 2, an enlarged configuration, such as shown in FIG. 3, and a compact configuration, such as shown in FIGS. 6-7. A dual configuration includes two lid housings (12) connected together in the compact configuration and nested at least partially within base housing (14) upon securement. An enlarged configuration of container (10) includes one lid housing (12) for connecting with one base housing (14). In contrast, a compact configuration of container (10) includes two lid housings (12) for connecting with each other. Container (10) may thus include first lid housing (12), second lid housing (12), and/or base housing (14) to be selectively connected in dual, enlarged, or compact configurations as desired by the user. Of course, to accommodate these selective configurations, double lock securement (16) is configured to provide for releasably connecting first lid housing (12) to base housing (14) and/or to another, second lid housing (12) as discussed below in greater detail.

With respect to FIGS. 1-3, double lock inner securement (16) of the present example includes lid housing and base housing securement portions (18, 20) respectively on lid housing (12) and base housing (14). Base housing (14) more particularly includes a front sidewall (24), a rear sidewall (26) opposite front sidewall (24), a left sidewall (28), and a right sidewall (30) opposite left sidewall (28). Front and rear sidewalls (24, 26) extend to corner sidewalls (32) with left and right sidewalls (28, 30) similarly extending to corner sidewalls (32) defining a generally rectangular shape in the present example. Notably, any references to front, rear, left, and right are merely exemplary as to the present figures and not intended to unnecessarily limit the invention described herein. Also, while the present arrangement of sidewalls (24, 26, 28, 30, 32) define a generally rectangular base (14), it can be appreciated that alternative shapes may be similarly constructed such that the invention is not intended to be unnecessarily limited the example described herein.

Base housing (14) further includes a bottom (34), with sidewalls (24, 26, 28, 30, 32) vertically extending upward therefrom to an upper peripheral frame (36), which defines an opening (38) into a base chamber (40). In this respect, base chamber (40) may be defined by sidewalls (24, 26, 28, 30, 32), bottom (34), and upper peripheral frame (36), although additional features may further define base chamber (40) in one or more examples. Upper peripheral frame (36) can be configured to provide rigidity to base housing (14) about opening (38) and further includes an upper sealing surface (42) configured to engage a lower sealing surface (44) (see FIG. 5) on lid housing (12) to inhibit contents within inner storage space (11) from leaking between upper and lower sealing surfaces (42, 44) and outward to the surrounding environment. In the present example, each of upper and lower sealing surfaces (42, 44) (see FIG. 5) are continuous for better sealing that surrounds opening (38). Notably, sealing that occurs against "sealing surfaces" as those terms are used herein generally inhibits contents from leaking therethrough, but some leaking may still be possible as used herein. References to "sealing surfaces" are thus not intended to be unnecessarily limited to a fluid seal.

Figure 5:
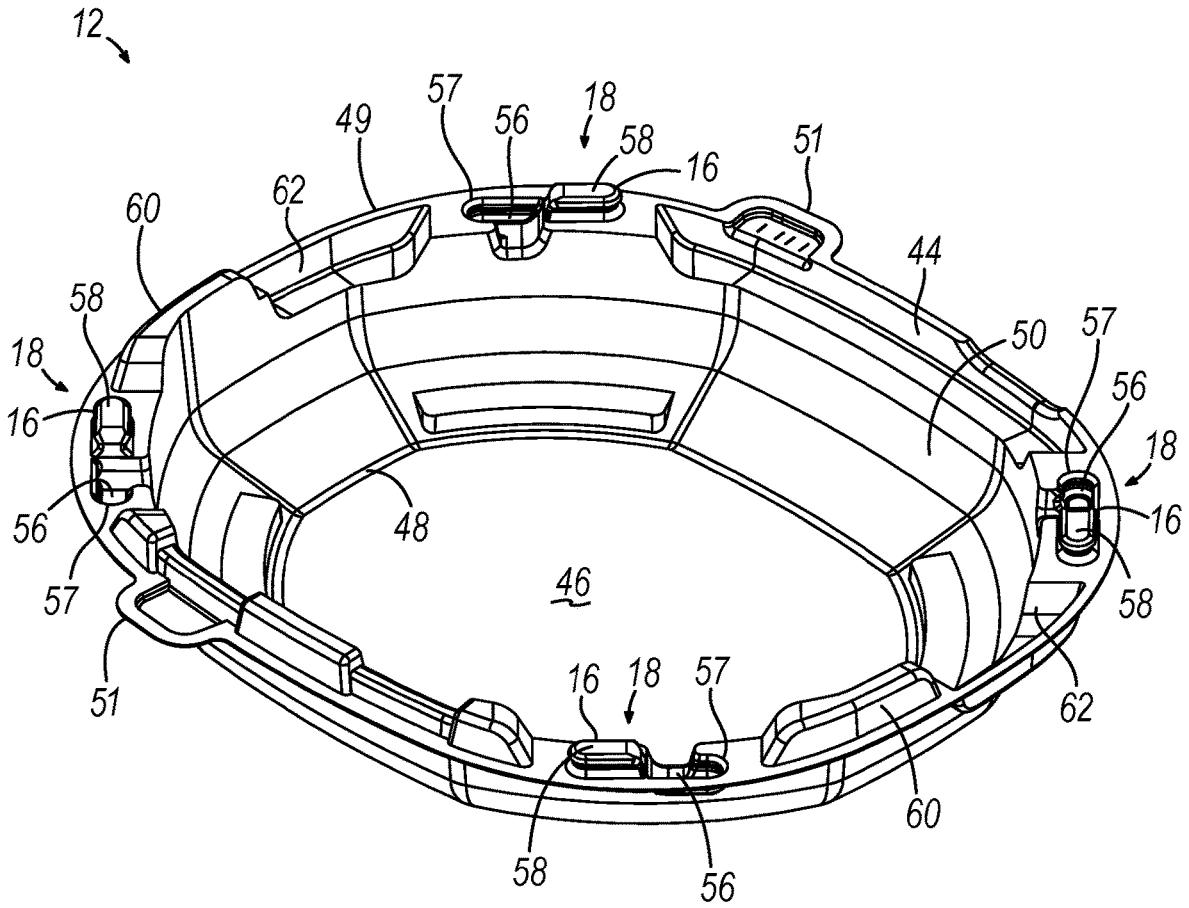
FIG. 5 depicts a perspective view of the lid of FIG. 1.

To this end, lid housing (12) of the present example includes a cover (46) with a lid stacking frame (48) and a lower peripheral frame (49) configured to provide rigidity to lid housing (12). Lower peripheral frame (49) further includes lower sealing surface (44), as discussed above, and surrounds cover (46) such that cover (46) extends therebetween and upward therefrom. Cover (46) of the present example can also be generally rectangular in shape to complement base housing (14) and can be domed to further define a lid chamber (50). When connected together, lid chamber (50) and base chamber (40) collectively define inner storage space (11). Of course, lid housing (12) may take alternative shapes to that shown in the present example such that the invention should not be intended to be unnecessarily limited to the domed and/or rectangular shape described herein. Lid housing (12) also respectively includes at least one grip tab (51) extending from lower peripheral frame (49), externally of lid chamber (50) to aid in gripping and removal of lid housing (12) from a base housing (14) or from a second lid housing (12) as discussed below in greater detail. Each end portion of lid housing (12) also respectively includes an end protrusion (60) adjacent an end channel (62). As can be seen in FIG. 5, end protrusion (60) on a first end portion of lid housing (12) can be located directly opposite end protrusion (60) on a second end portion of lid housing (12) just as end channel (62) on the first end portion of lid housing (12) can be located directly opposite end channel (62) on the second end portion of lid housing (12).

Figure 4:
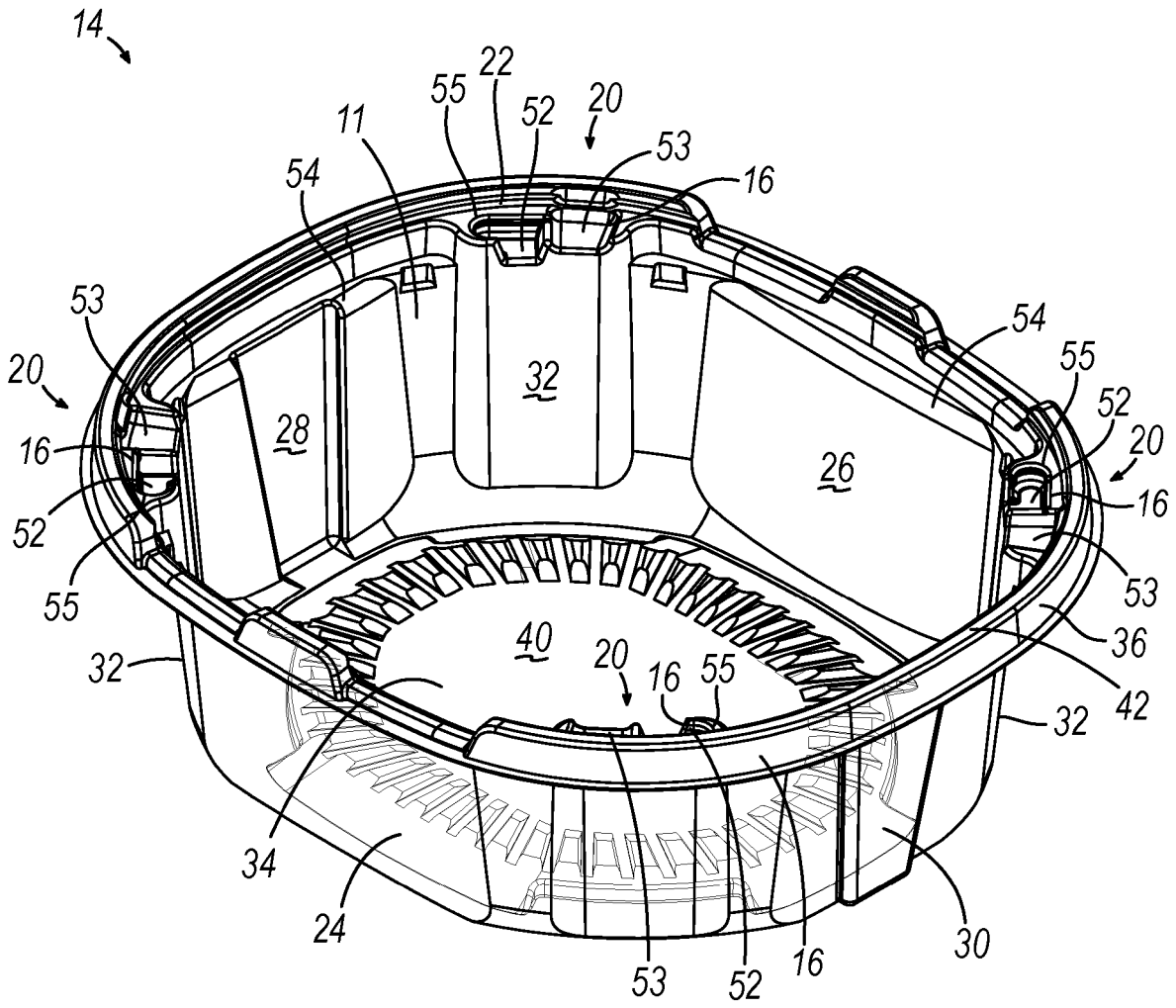
FIG. 4 depicts a perspective view of the base of FIG. 1.

Double lock inner securement (16) has base securement portion (20) on base housing (14) and lid securement portion (18) on lid housing (12). FIG. 4 shows each base securement portion (20) of double lock inner securement (16) as more particularly including an active recess (52) with a detent (55) positioned adjacent to a passive recess (53) without a detent. Both active recess (52) and passive recess (53) extend downwards into corner sidewall (32) with active recess (52) extending further downwards than passive recess (53). As will be discussed in greater detail below, active recess (52) can be utilized to releasably connect with lid securement portion (18) on lid housing (12), whereas passive recess (53) is not configured for such releasable connection. Base housing (14) further includes a support frame (54) extending radially inward and downward from upper peripheral frame (36). Support frame (54) of the present example can be incorporated into portions of sidewalls (24, 26, 28, 30) to surround base chamber (40) and provide rigidity and support to base housing (14), such as while compressing lid housing (12) against base housing (14) during use.

Active recess (52) and passive recess (53) of each base securement portion (20) of the double lock inner securement (16) are positioned inward from upper peripheral frame (36) such that upper peripheral frame (36) surrounds both active recess (52) and passive recess (53) of each base securement portion (20). Such inward positioning more effectively leverages compression against lid housing (12) while releasably connecting lid housing (12) to base housing (14). Notably, all of base housing (14), including sidewalls (24, 26, 28, 30, 32), bottom (34), upper peripheral frame (36), support frame (54), active recesses (52), and passive recesses (53), are integrally formed of unitary construction, specifically thermoformed of polypropylene material in the present example. Alternative constructions of differing material may be used in one or more examples such that the invention may not be intended to be unnecessarily limited to being constructed as shown herein.

FIG. 5 shows lid housing (12) and each lid housing securement portion (18) of double lock inner securement (16) as more particularly including a recess (56) with a detent (57) adjacent a protuberance (58). Referring back to FIG. 2 with respect to the dual configuration of container (10), first lid housing (12) is connected to base housing (14) and second lid housing (12) is connected to first lid housing (12). To accomplish this, a bottom of each recess (56), which has like dimensions and capabilities of protuberances (58), can be positioned into a snapped locked relationship with active recesses (52) of base securement portion (20) on base housing (14). Then, protuberances (58) of each lid housing securement portion (18) on first lid housing (12) can be positioned into a snapped locked relationship with recesses (56) of each lid housing securement portion (18) of second lid housing (12). Similarly, protuberances (58) of each lid housing securement portion (18) on second lid housing (12) can be positioned into a snapped locked relationship with recesses (56) of each lid housing securement portion (18) of first lid housing (12). In other embodiments, first lid housing (12) and second lid housing (14) can be snap locked together first, then first lid housing (12) can be snap locked to base housing (14) as discussed above.

Figure 8:
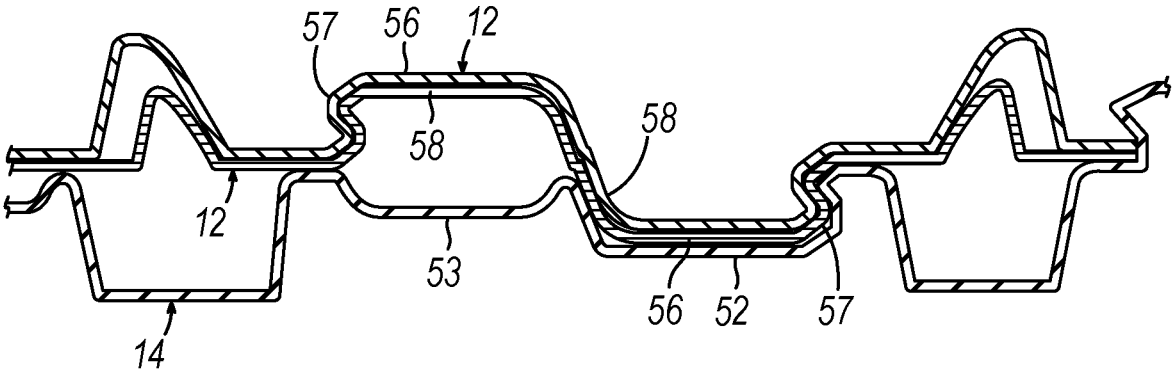
FIG. 8 depicts an enlarged section view of the double lock securement connected in the dual configuration of FIG. 2.

The snapped locked relationship with first lid housing (12), second lid housing (12), and base housing (14) can be seen in more detail in FIG. 8, which shows protuberance (58) of lid housing securement portion (18) of first lid housing (12) being snap locked into recess (56) of lid securement portion (18) of second lid housing (12). Simultaneously in FIG. 8, protuberance (58) of lid securement portion (18) of second lid housing (12) is shown snap locked into recess (56) of lid securement portion (18) of first lid housing (12). Additionally in FIG. 8, it can be seen that the bottoms of each recess (56) of lid housing securement portion (18) of first lid housing (12) are snapped locked with active recesses (52) of base securement portion 20 on base housing (14). As discussed above, each lid housing (12) includes at least one grip tab (51) extending therefrom. With container (10) in the dual configuration, the at least one grip tab (51) of first lid housing (12) can be offset from the at least one grip tab (51) of second lid housing (12) to aid in gripping and removal of first lid housing (12) from second lid housing (12). Once second lid housing (12) has been removed, the at least one grip tap (51) of the first lid housing (12) can be utilized to remove first lid housing (12) from base housing (14).

Figure 9:
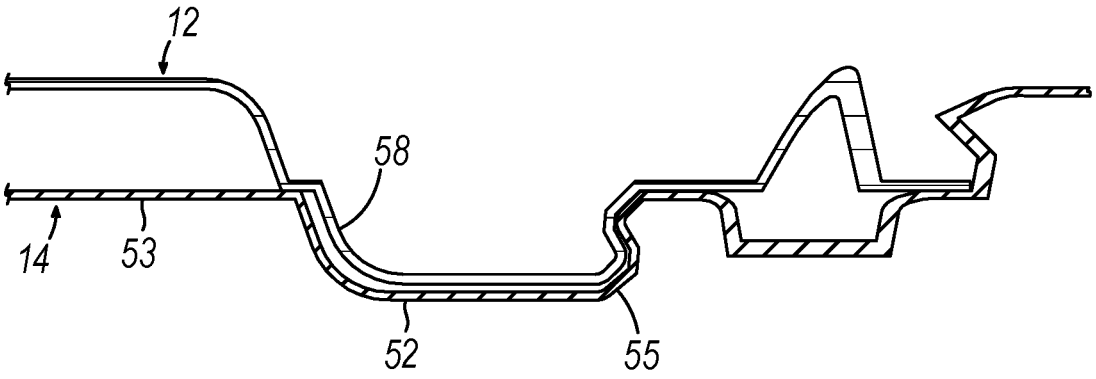
FIG. 9 depicts an enlarged sectional view of the double lock securement connected in the enlarged configuration of FIG. 3.

When lid housing (12) is connected to base housing (14) in the enlarged configuration, such as shown in FIG. 3, protuberances (58) of each lid housing securement portion (18) on lid housing (12) can be positioned into a snapped locked relationship with active recesses (52) of base securement portion (20) on base housing (14). The snapped locked relationship with lid housing (12) and base housing (14) can be seen in more detail in FIG. 9, which shows a protuberance (58) of a lid housing securement portion (18) being snap locked into place within an active recess (52) of base securement portion (20). FIG. 9 also shows how recess (56) of lid housing securement portion (18) and passive recess (53) of base securement portion (20) do not interact with one another when a lid housing (12) is connected to a base housing (14).

Figure 10:
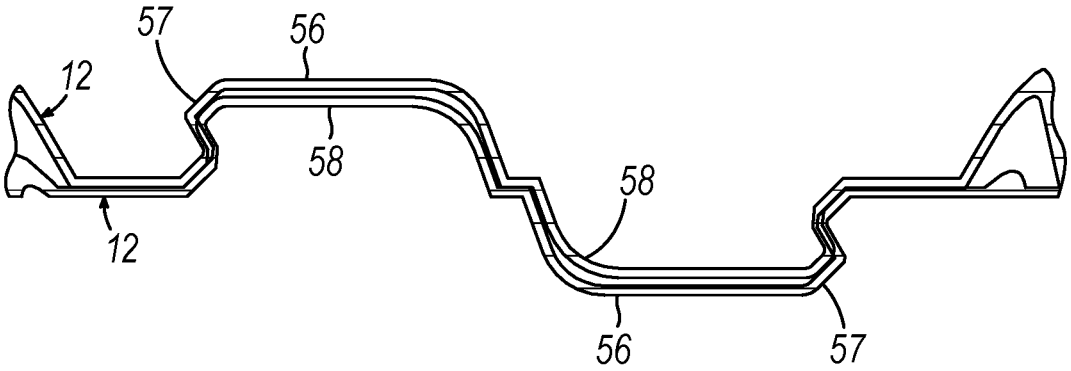
FIG. 10 depicts an enlarged sectional view of the double lock securement connected in the compact configuration of FIG. 6.

When a first lid housing (12) is connected to second lid housing (12) in the compact configuration, such as shown in FIGS. 6 and 7, protuberances (58) of each lid housing securement portion (18) on first lid housing (12) can be positioned into a snapped locked relationship with recesses (56) of each lid housing securement portion (18) of second lid housing (12). Similarly, protuberances (58) of each lid housing securement portion (18) on second lid housing (12) can be positioned into a snapped locked relationship with recesses (56) of each lid housing securement portion (18) of first lid housing (12). The snapped locked relationship with first lid housing (12) and second lid housing (12) can be seen in more detail in FIG. 10, which shows protuberance (58) of lid housing securement portion (18) of first lid housing (12) being snap locked into recess (56) of lid securement portion (18) of second lid housing (12). Simultaneously in FIG. 10, protuberance (58) of lid securement portion (18) of second lid housing (12) is shown snap locked into recess (56) of lid securement portion (18) of first lid housing (12). As discussed above, each lid housing (12) includes at least one grip tab (51) extending therefrom. With container (10) in the compact configuration, the at least one grip tab (51) of first lid housing (12) can be offset from the at least one grip tab (51) of second lid housing (12) to aid in gripping and removal of first lid housing (12) from second lid housing (12).

As discussed above, each end portion of each lid housing (12) also respectively includes end protrusion (60) adjacent to end channel (62). As shown in the present example, end protrusions (60) on one lid housing (12) align with end channels (62) of another lid housing (12) in a predetermined alignment such that end protrusions (60) are received within end channels (62). This predetermined alignment aids with alignment of protuberances (58) and recesses (56) to ease connecting lid housings (12) in the compact configuration. In contrast, the positioning of end protrusions (60) and end channels (62) are thus further configured to inhibit two lid housings (12) from being in a snap locked relationship with each other unless the orientation of the end protrusions (60) of first lid housing (12) are aligned with the predetermined alignment to achieve the snap fit relationship discussed above.

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

II. EXEMPLARY COMBINATIONS

Example 1

A container assembly, comprising: (a) a first housing, wherein the first housing includes a first portion of a double lock securement including a first recess and a first protuberance adjacent to the recess; and (b) a second housing, wherein the second housing includes a second portion of the double lock securement including at least one second recess; wherein the first protuberance of the first housing is configured to releasably lock with the at least one second recess of the second housing.

Example 2

The container assembly of Example 1, wherein the first housing is a first lid housing, wherein the first lid housing includes a cover and a lower peripheral frame.

Example 3

The container assembly of Example 2, wherein the second housing is a base housing, wherein the base housing includes a bottom, an upper peripheral frame, and a plurality of sidewalls extending upward from the bottom to the upper peripheral frame, and wherein the second portion of the double lock securement includes an active recess and a passive recess.

Example 4

The container assembly of Example 3, wherein the first protuberance of the first lid housing releasably locks with the active recess of the base housing.

Example 5

The container assembly of Example 4, wherein the first lid housing further includes at least one grip tab extending from the lower peripheral frame to aid in gripping and removal of the first lid housing from the base housing.

Example 6

The container assembly of any one or more of Examples 4 through 5, wherein the active recess of the base housing includes a detent such that the first protuberance of the first lid housing is configured to releasably snap lock with the active recess of the base housing.

Example 7

The container assembly of Example 3, further comprising a third housing, wherein the third housing is a second lid housing, wherein the second lid housing includes a first recess and a first protuberance adjacent to the recess, wherein a bottom of the first recess of the second lid housing releasably locks with the active recess of the base housing, and wherein the first protuberance of the second lid housing releasably locks with the first recess of the first lid housing while the protuberance of the first lid housing releasably locks with the first recess of the second lid housing.

Example 8

The container assembly of Example 2, wherein the second housing is a second lid housing, wherein the second lid housing includes a cover and a lower peripheral frame, and wherein the second portion of the double lock securement further includes a second protuberance adjacent to the at least one second recess.

Example 9

The container assembly of Example 8, wherein the first protuberance of the first lid housing releasably locks with the at least one second recess of the second lid housing, and wherein the second protuberance of the second lid housing releasably locks with the first recess of the first lid housing.

Example 10

The container assembly of Example 9, wherein the first recess of the first lid housing includes a detent such that the second protuberance of the second lid housing is configured to releasably snap lock with the first recess of the first lid housing, and wherein the at least one second recess of the second lid housing includes a detent to allow for the first protuberance of the first lid housing to releasably snap lock with the at least one second recess of the second lid housing.

Example 11

The container assembly of any one or more of Examples 8 through 10, wherein the first lid housing further includes a first end protrusion proximate to a first end channel, wherein the second lid housing further includes a second end protrusion proximate a second end channel, and wherein the first end protrusion of the first lid housing is received withing the second end channel of the second lid housing while the second end protrusion of the second lid housing is received withing the first end channel of the first lid housing thereby urging alignment of the first lid housing relative to the second lid housing toward a predetermined alignment.

Example 12

A method of assembling a container assembly, comprising: (a) selecting a first housing comprising a first portion of a double lock securement including a first recess and a first protuberance adjacent to the first recess; (b) selecting a second housing comprising a second portion of a double lock securement including at least one second recess; (c) flipping the first housing upside-down relative to the second housing such that the first portion of the double lock securement overlaps with the second portion of the double lock securement; and (d) releasably locking the protuberance of first housing with the at least one recess of the second housing thereby at least partially assembling the container assembly.

Example 13

The method of assembling a container assembly of Example 12, wherein the first housing is a first lid housing, wherein the first lid housing includes a cover and a lower peripheral frame.

Example 14

The method of assembling a container assembly of Example 13, wherein the second housing is a base housing, wherein the base housing includes a bottom, an upper peripheral frame, and a plurality of sidewalls extending upward from the bottom to the upper peripheral frame, and wherein the second portion of the double lock securement includes an active recess and a passive recess.

Example 15

The method of assembling a container assembly of Example 14, wherein releasably locking includes releasably locking the first protuberance of the first lid housing with the active recess of the base housing.

Example 16

The method of assembling a container assembly of Example 15, wherein the first lid housing further includes at least one grip tab extending from the lower peripheral frame to aid in gripping and removal of the first lid housing from the base housing.

Example 17

The method of assembling a container assembly of any one or more of Examples 12 through 16, wherein the second housing is a second lid housing, wherein the second lid housing includes a cover and a lower peripheral frame, and wherein the second portion of the double lock securement further includes a second protuberance adjacent to the at least one second recess.

Example 18

The method of assembling a container assembly of Example 17, wherein releasably locking includes releasably locking the first protuberance of the first lid housing with the at least one second recess of the second lid housing and releasably locking the second protuberance of the second lid housing with the first recess of the first lid housing.

Example 19

The method of assembling a container assembly of Example 18, wherein the first lid housing further includes a first end protrusion adjacent to a first end channel, wherein the second lid housing further includes a second end protrusion adjacent to a second end channel, and wherein the first end protrusion of the first lid housing is received within the second end channel of the second lid housing while the second end protrusion of the second lid housing is received withing the first end channel of the first lid housing thereby urging alignment of the first lid housing relative to the second lid housing toward a predetermined alignment.

Example 20

The method of assembling a container assembly of any one or more of Examples 18 through 19, wherein both the first lid housing and the second lid housing each include at least one grip tab extending respectively from each lower peripheral frame.

III. MISCELLANEOUS

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

I claim:

1. A container assembly, comprising:

(a) a first housing, wherein the first housing includes a first portion of a double lock securement including a first recess and a first protuberance, wherein the first protuberance is adjacent to the first recess such that the first protuberance is positioned directly against the first recess; and (b) a second housing, wherein the second housing includes a second portion of the double lock securement including at least one second recess;

wherein the first protuberance of the first housing is configured to releasably lock with the at least one second recess of the second housing, wherein the at least one second recess of the second portion of the double lock securement includes an active recess and a passive recess, wherein the active recess is configured to releasably lock with the first protuberance of the first housing, and wherein the passive recess is configured to not releasably lock with the first protuberance of the first housing.

2. The container assembly of claim 1, wherein the first housing is a first lid housing, wherein the first lid housing includes a cover and a lower peripheral frame.

3. The container assembly of claim 2, wherein the second housing is a base housing, and wherein the base housing includes a bottom, an upper peripheral frame, and a plurality of sidewalls extending upward from the bottom to the upper peripheral frame.

4. The container assembly of claim 3, wherein the first lid housing further includes at least one grip tab extending from the lower peripheral frame to aid in gripping and removal of the first lid housing from the base housing.

5. The container assembly of claim 3, wherein the active recess of the base housing includes a detent such that the first protuberance of the first lid housing is configured to releasably snap lock with the active recess of the base housing.

6. The container assembly of claim 3, further comprising a third housing, wherein the third housing is a second lid housing, wherein the second lid housing includes a first recess and a first protuberance adjacent to the first recess, wherein a bottom of the first recess of the second lid housing releasably locks with the active recess of the base housing, and wherein the first protuberance of the second lid housing releasably locks with the first recess of the first lid housing while the first protuberance of the first lid housing releasably locks with the first recess of the second lid housing.

7. A method of assembling a container assembly, comprising:

(a) selecting a first lid housing comprising a first portion of a double lock securement including a first recess and a first protuberance adjacent to the first recess;

(b) selecting a second lid housing comprising a second portion of a double lock securement including a second recess and a second protuberance adjacent to the second recess;

(c) flipping the first lid housing upside-down relative to the second lid housing such that the first portion of the double lock securement overlaps with the second portion of the double lock securement; and (d) releasably locking the first protuberance of first lid housing with the second recess of the second lid housing and releasably locking the second protuberance of the second lid housing with the first recess of the first lid housing thereby at least partially assembling the container assembly.

8. The method of claim 7, wherein the first lid housing includes a cover and a lower peripheral frame.

9. The method of claim 8, wherein the second lid housing includes a cover and a lower peripheral frame.

10. The method of claim 7, wherein the first lid housing further includes a first end protrusion adjacent to a first end channel, wherein the second lid housing further includes a second end protrusion adjacent to a second end channel, and wherein the first end protrusion of the first lid housing is received within the second end channel of the second lid housing while the second end protrusion of the second lid housing is received withing the first end channel of the first lid housing thereby urging alignment of the first lid housing relative to the second lid housing toward a predetermined alignment.

11. The container assembly of claim 1, wherein the active recess is positioned adjacent to the passive recess such that the active recess is positioned directly against the passive recess.

12. The container assembly of claim 1, wherein the active recess includes a detent, wherein the passive recess does not include a detent.

13. The container assembly of claim 1, wherein the second housing includes a peripheral frame, and wherein the active and passive recesses are positioned inward of the peripheral frame such that the peripheral frame surrounds both active and passive recesses.

14. The container assembly of claim 1, wherein the active recess is positioned adjacent to the passive recess such that the active recess is positioned directly against the passive recess, wherein the active recess includes a detent, wherein the passive recess does not include a detent, wherein the second housing includes a peripheral frame, and wherein the active and passive recesses are positioned inward of the peripheral frame such that the peripheral frame surrounds both active and passive recesses.

15. A container assembly, comprising:

(a) a first lid housing, wherein the first lid housing includes a first recess and a first protuberance adjacent to the first recess;

(b) a base housing, wherein the base housing includes an active recess; and (c) a second lid housing, wherein the second lid housing includes a second recess and a second protuberance adjacent to the second recess wherein the first protuberance of the first lid housing is configured to releasably lock with the active recess of the base housing, wherein a bottom of the second recess of the second lid housing is configured to releasably lock with the active recess of the base housing, and wherein the second protuberance of the second lid housing is configured to releasably lock with the first recess of the first lid housing while the first protuberance of the first lid housing releasably locks with the second recess of the second lid housing.

16. The container assembly of claim 15, wherein the first lid housing includes a cover and a lower peripheral frame, and wherein the base housing includes a bottom, an upper peripheral frame, and a plurality of sidewalls extending upward from the bottom to the upper peripheral frame.

17. The container assembly of claim 16, wherein the base housing includes a passive recess.

18. The container assembly of claim 17, wherein the active recess is configured to releasably lock with the first protuberance of the first lid housing, and wherein the passive recess is configured to not releasably lock with the first protuberance of the first lid housing.

19. The container assembly of claim 15, wherein the base housing includes a passive recess.

20. The container assembly of claim 19, wherein the active recess is configured to releasably lock with the first protuberance of the first lid housing, and wherein the passive recess is configured to not releasably lock with the first protuberance of the first lid housing.

* * * * *